US010109159B1

(12) United States Patent
Shoemaker, Jr.

(10) Patent No.: US 10,109,159 B1
(45) Date of Patent: Oct. 23, 2018

(54) ARCADE GAME WITH PRIZE DISTRIBUTION AND COLLECTION SYSTEM AND METHOD

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 15/667,422

(22) Filed: Aug. 2, 2017

(51) Int. Cl.
*G07F 17/32* (2006.01)
*A63F 9/00* (2006.01)
*A63F 9/30* (2006.01)

(52) U.S. Cl.
CPC ..... *G07F 17/3297* (2013.01); *A63F 9/0079* (2013.01); *A63F 9/30* (2013.01); *A63F 2009/0081* (2013.01)

(58) Field of Classification Search
CPC ..... G07F 17/3297; A63F 9/0079; A63F 9/30
USPC ..... 273/447
See application file for complete search history.

(56) References Cited

U.S. PATENT DOCUMENTS 4,778,176 A * 10/1988 Shoemaker, Jr. ..... A63F 9/30 212/225
5,553,865 A * 9/1996 Shoemaker, Jr. ... G07F 17/3297 108/20
5,855,374 A * 1/1999 Shoemaker, Jr. ..... A63F 9/30 273/447
7,192,342 B2 * 3/2007 Shoemaker, Jr. ..... A63F 9/30 273/138.3
8,678,395 B2 * 3/2014 Shoemaker, Jr. ..... F41J 5/24 273/454
2017/0109970 A1 * 4/2017 Stimac ..... G07F 17/3248

FOREIGN PATENT DOCUMENTS

JP 2004105433 A * 4/2004
JP 2004194880 A * 7/2004
JP 2004248797 A * 9/2004
JP 2005230262 A * 9/2005

* cited by examiner

*Primary Examiner* — Melba Bumgarner
*Assistant Examiner* — Laura L Davison
(74) *Attorney, Agent, or Firm* — Fulwider Patton LLP

(57) ABSTRACT

A prize replacement system for a pusher-type or crane type arcade game is disclosed where prizes are randomly distributed over the playing field by using a rotating playing field and a prize replacement unit that drops a replacement prize onto the playing field after a prize has been won. A vacuum device collects a new prize from a storage area below the playing surface, moves the prize over the playing field, and drops the prize as the playing field rotates below. Preferably the vacuum device is capable of selecting prizes of different shapes and sizes so that a wide variety of prizes can be used with the game of the present invention.

1 Claim, 6 Drawing Sheets

ARCADE GAME WITH PRIZE DISTRIBUTION AND COLLECTION SYSTEM AND METHOD

BACKGROUND

This invention is directed to arcade games, and more particularly to arcade games where prizes are pushed or slid across a playing field into a player's collection bin, or otherwise captured within the game necessitating the refilling and redistribution of the remaining prizes.

Pusher type arcade games are well known in the art, where a pusher maneuvered by a player moves a prize by either sliding the one or more prizes into a collection bin or otherwise "knocking" a prize into the bin. The pusher is typically arranged on a support system that can be controlled by the player. If the player has successfully positioned the pusher, the player may acquire the prize/target and retrieve it from the collection bin for redemption, collection, etc. The prior art is rife with such games, although advancements are continuously made due to the popularity of such games.

The games are predominantly skill-based with an element of minimal chance woven into the overall operation of the games. In games where prizes are collected from the game, an issue arises as to how to replenish the prize supply automatically so that an operator is not tasked with constant monitoring of the game. The issue with automatic prize replenishment is that prizes tend to collect at the location where the game inserts replacement prizes, creating a situation where the prize field is not evenly or properly distributed. Devices designed to spread out the prizes frequently jam or are ineffective in evening out the prize distribution. This is especially true for smaller prizes that are found in today's arcade games, such as tokens, poker chips, gift cards, and the like. Moreover, with prizes that are thin and can stack, the issue of jamming is present where the prizes stick or block the pusher or other movement device. The present invention is designed to overcome the shortcomings of the prior art prize distribution mechanisms.

SUMMARY OF THE INVENTION

The present invention is a prize replacement system and method for a pusher-type or rotary vacuum type arcade game where prizes are randomly distributed over the playing field by using a rotating playing field and a dispenser mechanism that places a replacement prize onto the playing field after a prize has been won. The game uses a sensor that determines when a prize has been won by the player, and initiates a process whereby a pusher device collects a new prize from a storage area below the rotating table, moves the prize over the playing field, and drops/places the prize onto the playing field as the playing field rotates below. Storing prizes below the table is beneficial since there is more room to stack cards, tokens, or coins, and the top of the game does not need to be removed for reloading the dispenser, allowing continuous play. A vacuum system is particularly well suited for reliably picking up the top prize from a container. For non-rotating playing fields, the pusher device can drop the prize after undertaking a pattern movement that covers the playing area, where each drop is designed to place the new target in a different area from the previous drop. Preferably the pusher or pick-up device is capable of selecting prizes of different shapes and sizes so that a wide variety of prizes can be used with the game of the present invention.

In a preferred embodiment of the present invention, the prize replacement unit comprises a columnar tube located below the playing surface of the game with a stack of replacement prizes such as coins, tokens, chips, or gift cards. Upon the occurrence of a player winning a prize, the processor sends a signal to the replacement unit (opening or closing a switch) to cause a pick-up device to move over the tube and then lower a vacuum piece, magnet, or other extraction element onto the uppermost prize on the stack. The extraction element, e.g. a vacuum, activates to acquire the uppermost prize and the extraction element is raised out of the tube by a pulley system connected to a gear motor. The pick-up device is then maneuvered over the playing field by a carriage horizontally driven by the same pulley system until the pusher device, with the extraction element still retaining the prize, is positioned over the playing field. The processor then opens a valve or relay to cause the extraction element to release the prize, allowing it to free fall onto the playing surface. The fall of the prize on to the playing surface will randomly distribute the prizes, particularly where the playing field rotates beneath the suspended pick-up device. The processor can be programmed to release the prize at different positions over the playing field to further enhance the distribution of the prizes below.

On the opposite side of the game, a player controls a pusher or vacuum mechanism that radially moves over a rotating playing field. Situated in front of the player is a collection chute that leads to a retrieval bin. A sensor in the collection chute, a vacuum switch, or similar device determines if, and how many. prizes or targets have been won by the player and sends a signal to the processor to replace the same number of prizes/targets with the prize replacement unit. In this manner, the game can continue with a constant number of targets, randomly distributed along the playing field, without constant monitoring by the game's operator.

These, and other benefits of the present invention will best be understood by reference to the following figures and the detailed description of the invention below.

DETAILED DESCRIPTION OF THE PREFERRED EMBODIMENTS

The present invention incorporates a rotating playing field in an arcade game such as the type described in U.S. Pat. No. 5,855,374 and U.S. Pat. No. 7,559,552, the contents of each of which are fully incorporated herein by reference.

Figure 1:
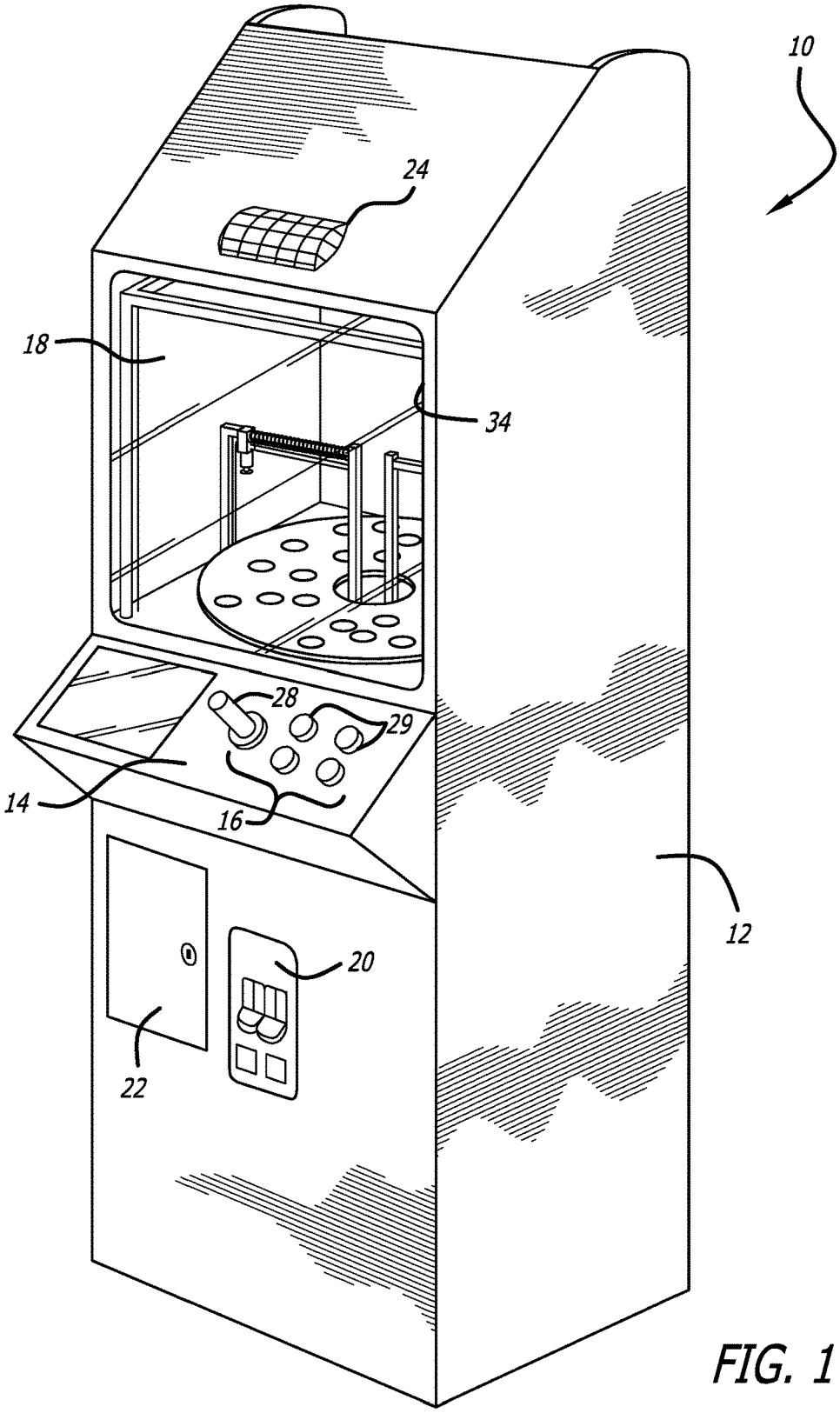
FIG. 1 is an elevated, perspective view of a first preferred embodiment of the present invention.

FIG. 1 is a perspective view of one embodiment of a game apparatus 10 in accordance with the present invention. Game apparatus 10 includes a housing 12, front panel 14, player controls 16, and a playing area 18.

Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. In other embodiments, other types of housings may be provided. For example, a counter-top housing, including approximately the upper half of housing 12 shown in FIG.

1, can be used when the game apparatus is desired to be placed on a table, counter top or other similar surface.

Front panel 14 can be positioned below the playing field 18, as shown in FIG. 1. The front panel can also be positioned in a wide variety of other locations on housing 12. Below the front panel on the housing 12 is a coin/token deposit slot 20 and a retrieval bin 22. Coin deposit slot 20 may be of the type that accepts standard currency coins, game tokens, bills, or reads magnetic game cards that are often available in an arcade environment. In some embodiments, other types of monetary input may also be provided, such as a credit card, debit card, etc. Prize retrieval area 22 is used to provide access to prizes that the player has won from playing the game. Prize retrieval area 22 preferably accesses a retrieval bin that collects prizes from a chute adjacent the playing field, where a prize from playing area 18 is pushed or dropped into the chute and down to the retrieval bin from which the player retrieves the prize. Speaker 24 emits sounds based on game actions and other game states and is controlled by a game control system as described subsequently. The front panel 14 can also include other features if appropriate. For example, in an alternative embodiment, a ticket dispenser (not shown) may be included on front panel 14 if desired to dispense a ticket award to the player based upon a game score, characteristics of a captured object, or other result or event of a game, rather than (or in addition to) providing the player with a prize in the dispenser 22.

Player controls panel 16 includes an input device to allow a player to manipulate events in the game, and typically include a joystick 28, buttons 29, knobs, or the like. Buttons 29 may also be used for various functions like to begin the game or to slow the rotation of the playing field. Game action occurs in playing area 18, where a pusher or pick-up mechanism may be controlled and guided by the player to slide, pick-up, or knock prizes off the playing field as described below. In the described embodiment, a joystick 28 or similar device (knob, two buttons, etc.) can be manipulated by the player to move the pusher or pick-up device radially along the rotating playing field. In alternate embodiments, the player may be able to control motion of other components of the game, such as lateral tilting of the playing field, non-radial movement of the pusher, or a vertical movement of the pusher mechanism. In some embodiments, a player may get multiple chances to guide the pusher mechanism with one coin or credit, or, alternatively, the player may be required to insert additional coins.

Game playing area 18 is used to display the game action and prizes to a player and is the area where game action occurs. A transparent shield 34 can prevent the player from interfering with game action. The playing area 18 houses a collection chute, a rotating playing field, a pusher mechanism, and a prize replacement unit. The player operates the pusher mechanism or pick-up device as prizes move past on the playing field, trying to use the pusher mechanism to slide one or more prizes into a retrieval bin. If a prize is pushed or dropped into the retrieval bin, the player may collect the prize and the game automatically replaces the prize on the playing field with a new prize. This automatic replacement can be triggered by an optical sensor, vacuum switch, or other sensor to determine when a prize has been captured by the player.

Figure 2:
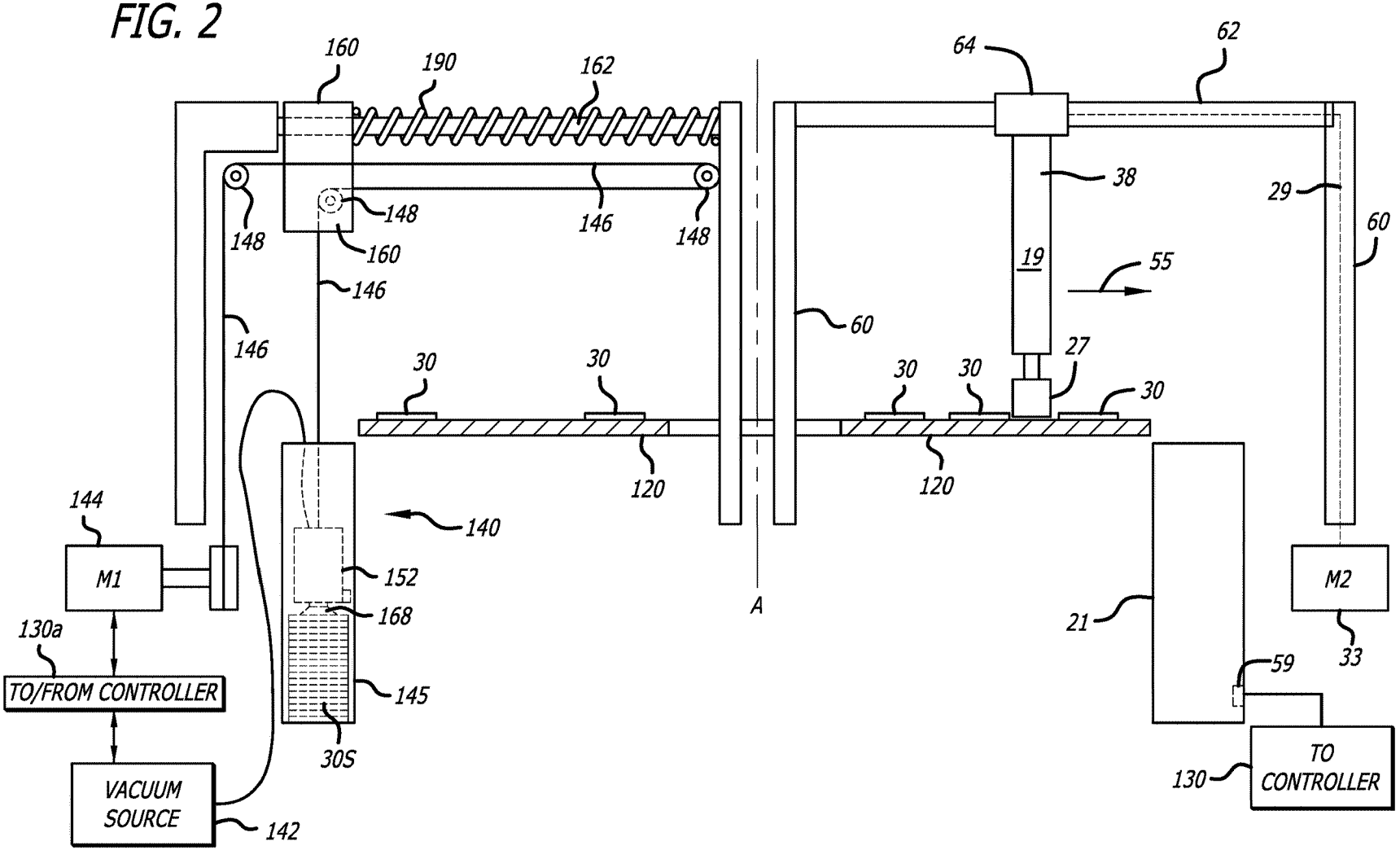
FIGS. 2-5 are a diagrammatic illustrations of a cross sectional view of the embodiment of FIG. 1 as the prize replacement unit executes a prize drop.

FIG. 2 is a schematic cross sectional view of playing area 18 of the game apparatus 10 of the present invention. Playing area 18 includes a rotating playing field 120 that rotates along a central axis A using a motor driven pulley system (not shown) whose construction and operation are well known in the art, and not repeated here for brevity. Prizes 30 are distributed over the surface of rotating playing field 120, and preferably have surfaces that allow the prize to slide across the playing field or be picked up. For example, objects such as gift cards, tokens, poker chips, laminated redemption coupons etc. can be used.

A pusher device 38 is used to move a prize 30 to the chute 21 which may be connected to a retrieval bin so that the player may access and remove the prize. Pusher device assembly includes vertical supports 60, a horizontal track 62, a pulley driven carrier 64, a vertical pusher body 19, a pusher head 27, a cable 29, and an electric motor 33. Vertical supports 60 extends up from floor surface approximately perpendicular to the surface of rotating playing field 120. Horizontal guide track 62 is mounted to the vertical supports 60 and extends over the rotating playing field 120. Preferably, the horizontal track 62 extends approximately radially toward the center of the table 120 such that axis A intersects the horizontal track 62. Alternatively, the horizontal track can be positioned at different angles relative to the playing area.

Carrier 64 is operative to move along the horizontal track 62. A carrier 64 may include a bore or cavity through which horizontal track 62 extends. A motor-driven pulley system for moving the carrier includes a cable 29 that is coupled to carrier 64 in a closed or continuous loop such that the carrier 64 moves along track 62 in accordance with the rotation of a shaft of the motor 33. That is, a rotation of the motor's shaft in a first direction rotates the cable 29 and the pulleys move the carrier (and therefore the pusher body 19) toward the center of the table 120, and rotation of the motor's shaft in the opposite direction movers the carrier toward the circumference of the table 120. In this manner, the motor 33 can position the pusher anywhere along a diameter of the rotating table 120. Further, the rotational movement of rotating playing field 120 combined with the linear (radial) movement of pusher assembly 64 allows the pusher to be positioned above any point on the surface of the rotary table. This allows the player to theoretically contact any prize 30 located on the rotary table. Therefore, when a rotating playing field 120 is used, the pusher 38 need only be moved in one horizontal axis, e.g., only x-axis movement need be provided instead of both x-axis and y-axis movement, thus simplifying the design of the game and leading to reduced cost to manufacture and maintain the game. In alternate embodiments, an x-y axis movement apparatus can be used to move the pusher assembly above any point on the prize surface, and the prizes 30 can be placed on a non-moveable surface.

On the playing field is a number of prizes or targets 30, which can be poker chips, baseball cards, gift cards, playing cards, tokens, or other symbolic or actual value objects that can be collected by a player. For example, gift cards having a monetary value that can be redeemed later at the arcade, or other restaurants or stores, can be used in the game and take up much less space that other conventional arcade game prizes, allowing the game operator to spend less time refilling the game prizes. The prizes may vary in value, creating a competition among players for the best prizes, or the prizes may all have the same value.

The player thus maneuvers the pusher or pick-up device along the radial line associated with the pusher device in the direction of arrow 55, attempting to push, knock, or pick-up a prize off the rotating table 120 and drop into chute 21. If successful, the prize then falls down the chute 21 to a retrieval bin, where it can be claimed by the player. At the entrance or the exit of the chute is preferably a sensor 59 that may be an optical sensor, a mechanical sensor, or any other detector that can detect a falling target 30. When the sensor perceives a target has been removed from the playing field 120 by the player, the sensor sends a signal to a controller 130. The controller then sends a signal to a second controller 130*a*, which may be either separate or part of the same controller, to initiate replacement of the prize on the table 120 using the prize replacement unit 140.

Prize replacement unit 140 includes a vacuum source 142, a controller 130*a*, a motor 144, a prize replacement tube 145, a cable 146, a plurality of pulleys 148, and a vacuum pick-up device 152. The controller 130*a* receives a signal from controller 130, which may be wired or wireless, and activates the motor 144 and the vacuum source 142. The motor 144 rotates a shaft that is coupled to the cable 146 until the carriage 160 is moved to a proximal position along a horizontal bar or track 162. When the carriage reaches the proximal position just off the table 120, the pick-up device 152 also connected to the cable 146 then lowers from the carriage 160 down into the replacement prize tube 145. With the vacuum source 142 active, the pick-up device, which may include a suction cup 168, comes in contact with an uppermost prize of a stack of prizes 30*s* in the replacement tube 145. The suction cup 168 attaches to the uppermost prize, and the motor 144 then rotates the shaft in the opposite direction. This causes cable 146 to rotate in a counterclockwise manner, initially pulling the pick-up device 152 vertically out of the replacement tube 145.

Once the pick-up device moves up to the carriage 160, further movement of the cable pulls the carriage horizontally across the track 162 over the playing field. Once the pick-up device is over the playing field, the vacuum source is disconnected by the controller 130*a*, and the prize is dropped onto the playing field 120. The movement of the prize falling from the pick-up device 152 will tend to randomly disperse the prizes across the playing field, particularly when the playing field is rotating. However, the controller can also be programmed to disconnect the vacuum source at different locations of the carriage 160 along the track 162, using either a counter on the track, software in the controller, or some other method for dropping the target along different radial positions. Once the pick-up device drops the replacement prize, the motor reverses direction until the carriage 160 is parked in a position off the playing field to ready the replacement unit for the next replacement operation. The pick-up device can also be used as the prize pick-up mechanism, thus simplifying the game.

The distance between the pick-up mechanism and the rotating playing surface can be great or small, depending on the configuration of the housing. A small distance is better for a top view game where the player looks down on the play. When the pick-up unit and the prize removal unit are the same and used for both purposes, there is an electronic stop of the solenoid preventing the player from moving the pick-up device over the prize during play. When restarting the game the programming allow the pick-up device to move over the stored prizes, thus completing the reloading process of the playing area.

Figure 3:
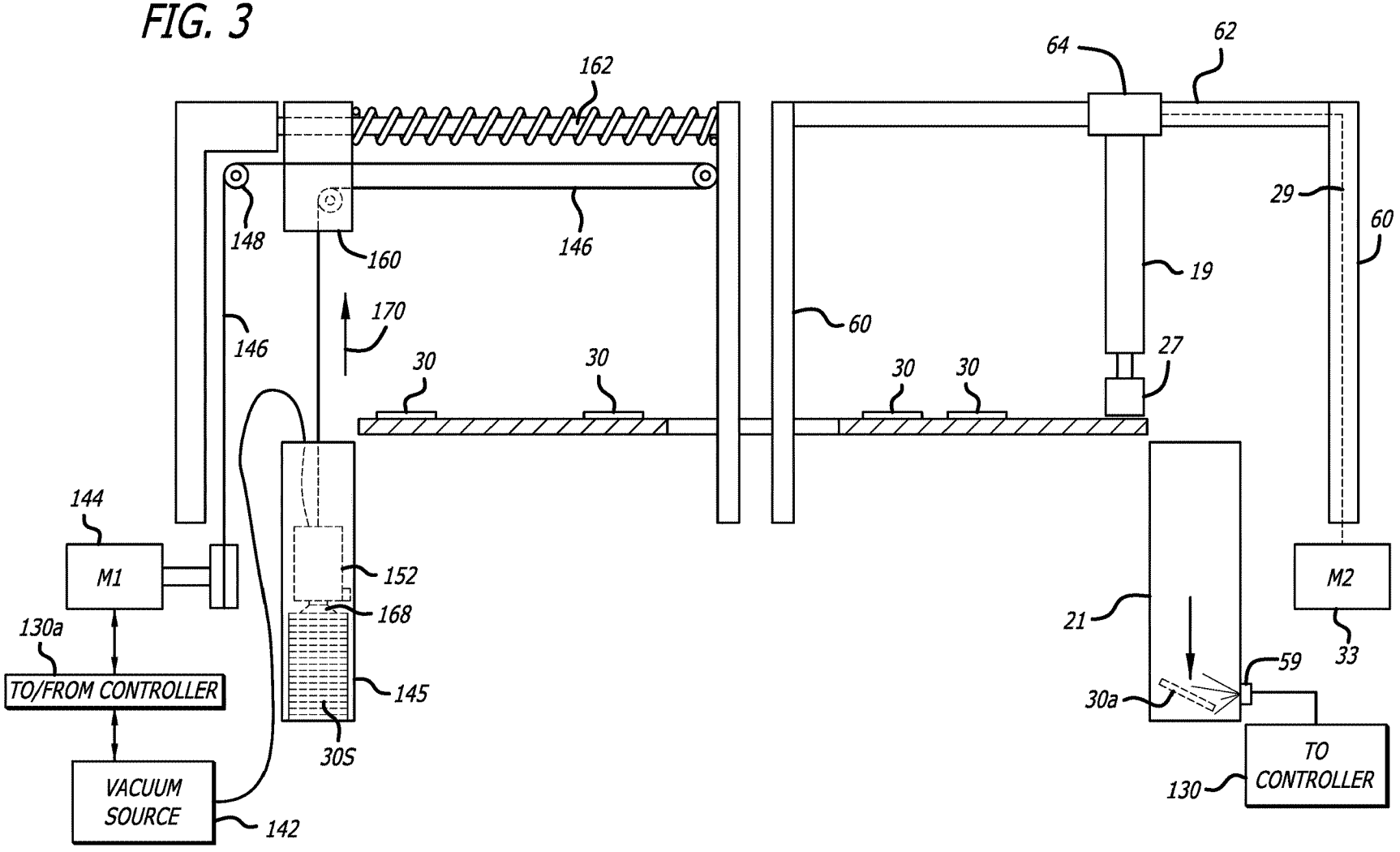

FIG. 2 illustrates the movement of the pusher or pick-up device 38 and the position of the replacement unit 140 with the pick-up device 152 within the replacement tube 145. In FIG. 3, a prize 30*a* has been pushed into the chute 21 by the player, causing the sensor 59 to recognize the falling prize. A signal is sent from the sensor 59 via controller 130 to controller 130*a*, which initiates the replacement operation. Motor 144 is actuated, along with vacuum source 142. The motor moves the pick-up device 152 into the replacement tube 145 that includes a stack of replacement prizes 30*s*. The pick-up device 152, using a suction cup 168, picks up the uppermost prize and begins to move in the direction of arrow 170.

Figure 4:
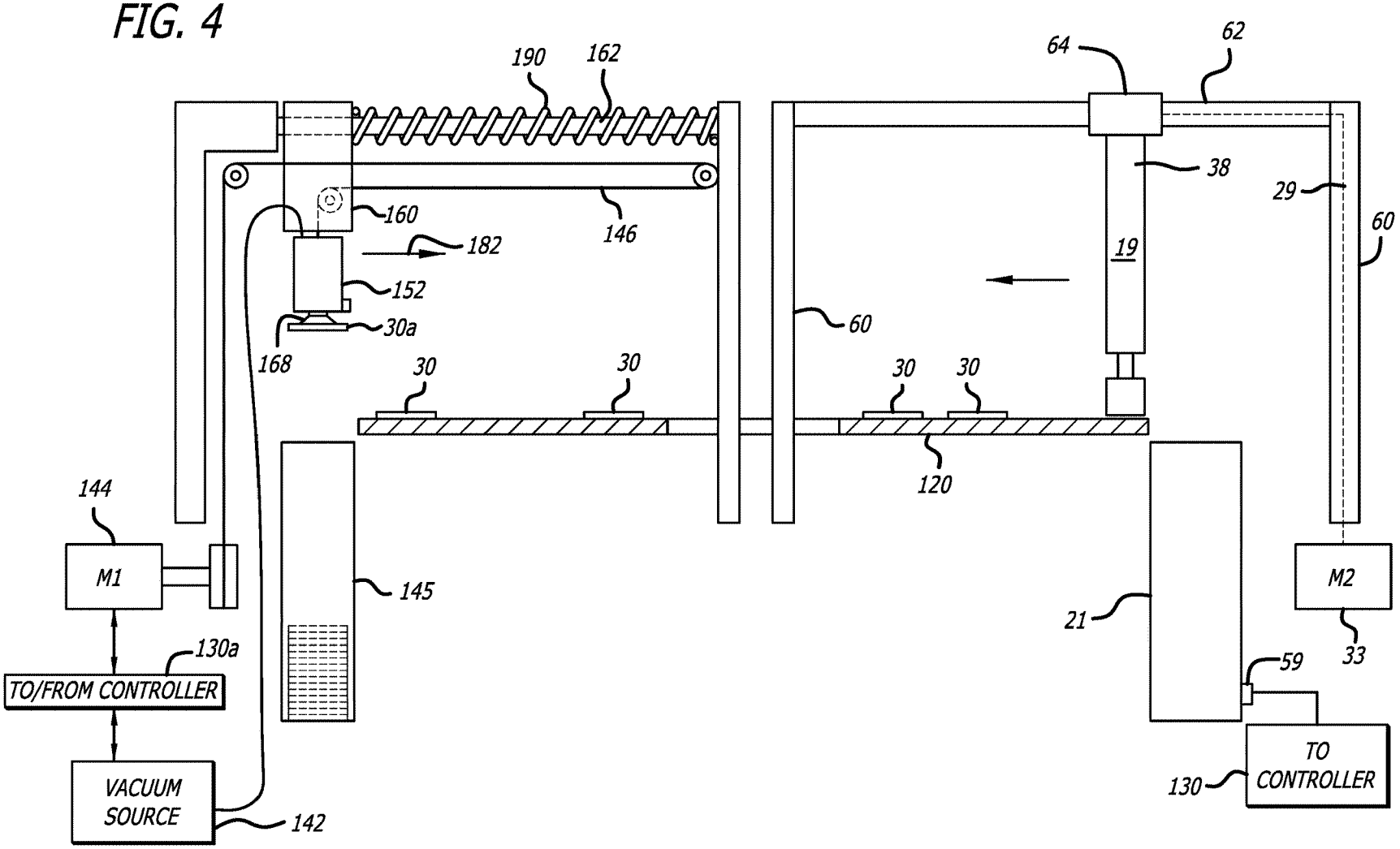
Figure 5:
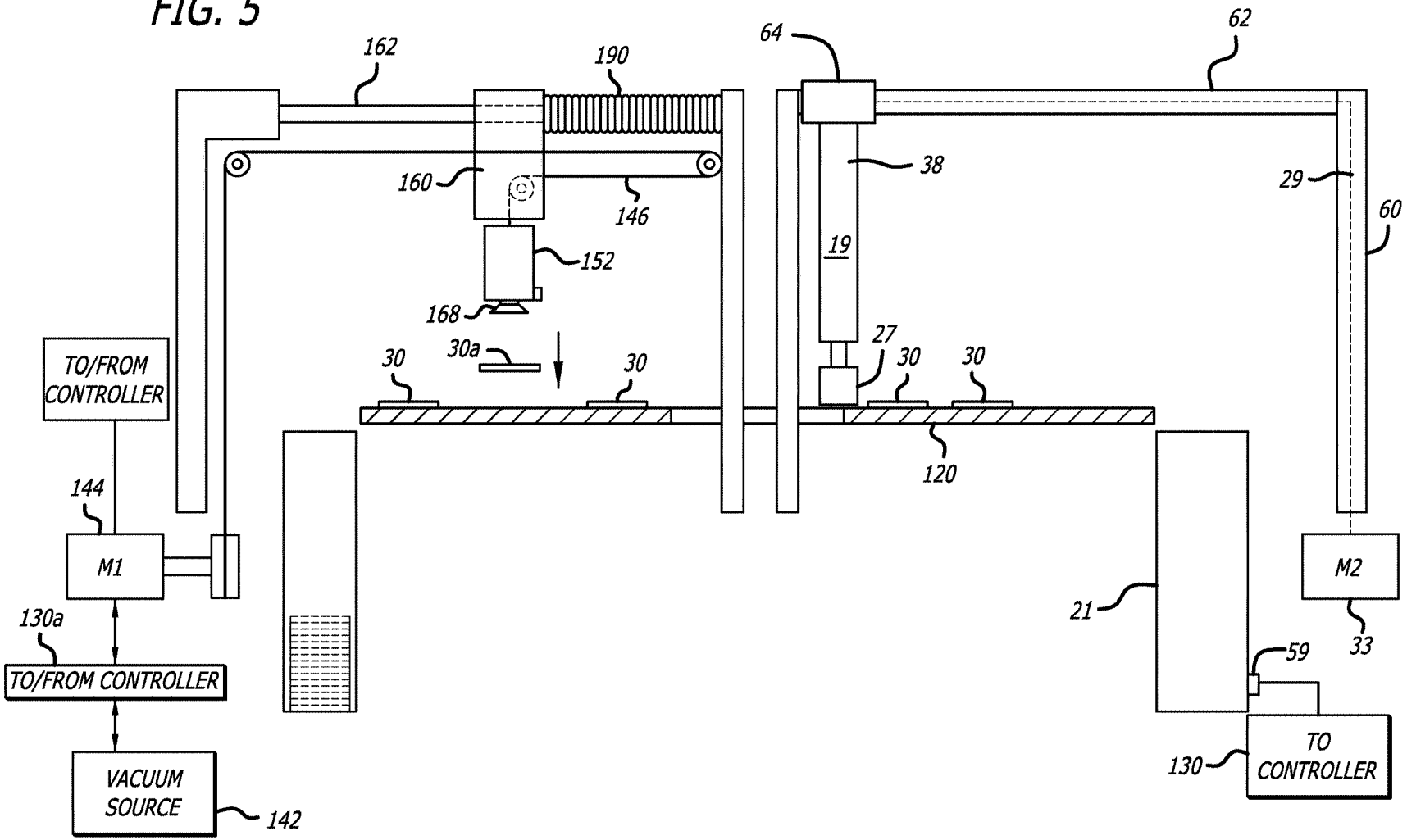

In FIG. 4, the pick-up device 152 has vertically reached the carriage 160, and the cable 146 then pulls the carriage 160 in the direction of arrow 182 over the playing field 120. The pick-up device carries a replacement prize 30*a* out of the replacement tube 145 and over the playing field 120. In FIG. 5, the controller 130*a* disconnects the vacuum source 142 from the suction cup of the pick-up device 152, causing the replacement prize 30*a* to drop onto the playing field 120. The movement of the carriage 160 may compress or extend a spring 190 that helps return the carriage to the parked or home position of FIG. 2 after the prize 30*a* has been dropped onto the playing field. In this manner, each prize removed from the playing field is automatically replaced in a random position on the playing field, ensuring fairness and continuity of the playing of the game without constant monitoring of the game by the operator.

Figure 6:
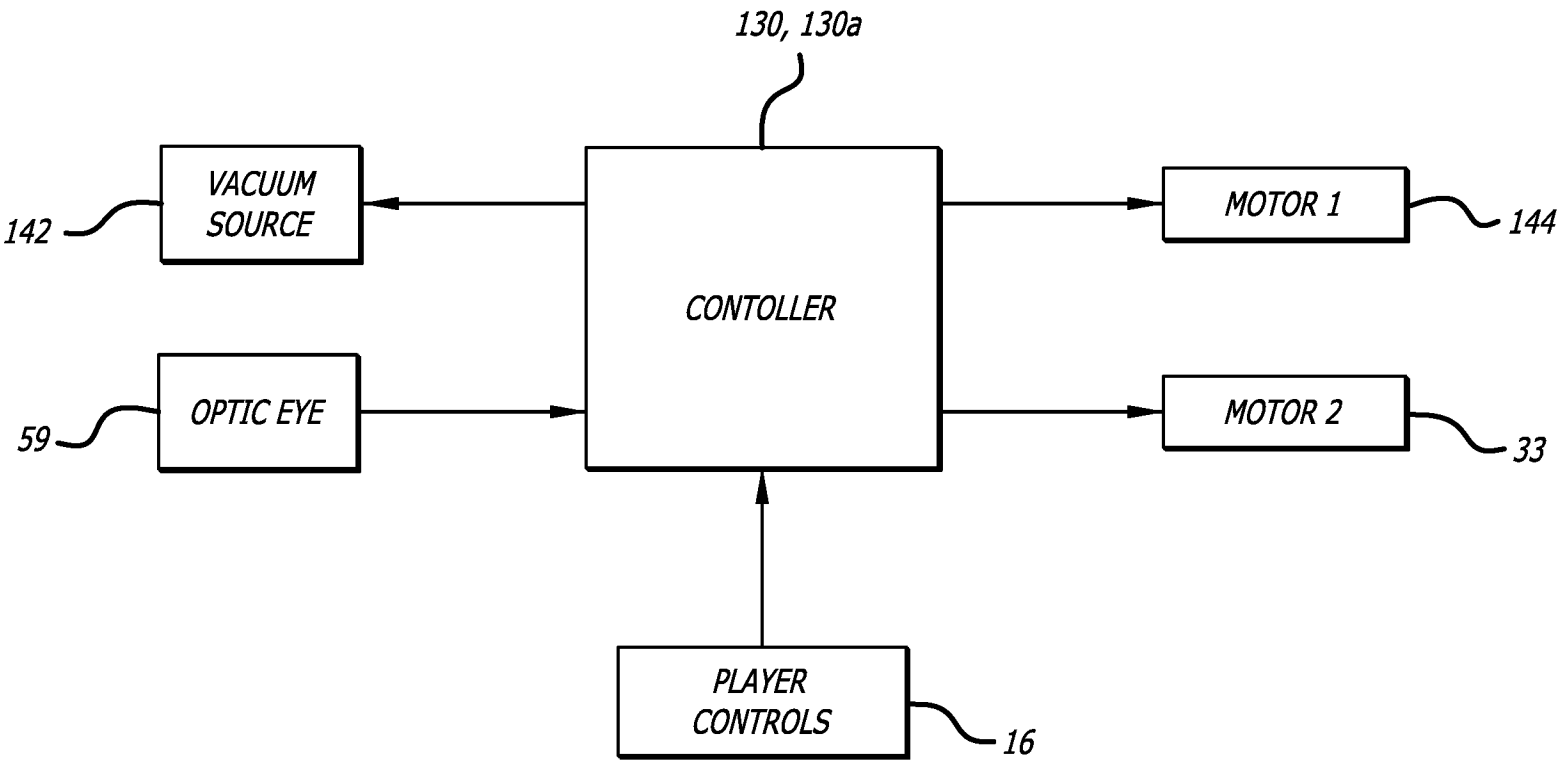
FIG. 6 is a schematic of the control system of the present invention.

FIG. 6 illustrates a schematic where a controller 130, 130*a* controls the operation of the two motors 33, 144 for positioning the carrier 64 and carriage 160, respectively. Moreover, the sensor 59 sends a signal to the controller 130, which in turn activates the vacuum source 142 to initiate the replacement operation. The player controls 16 are also connected to the controller 130 for controlling the movement of the pusher and, in some embodiments, the playing field 120.

Although a specific embodiment of the invention has been described, the invention is not limited to such specific embodiments and may be modified to meet other criteria of such games. One of ordinary skill in the art will readily appreciate various substitutions and modifications to the aforementioned embodiments, and the scope of the present invention should be interpreted to include all such substitutions and modifications.

I claim:

1. An arcade game with an automatic prize replacement system, comprising:

a rotating playing field with a plurality of prizes allocated on the rotating playing field;

a controller;

a prize extraction pusher for removing prizes from the rotating playing field;

a retrieval bin, adjacent to the rotating playing field, for receiving prizes extracted from the rotating playing field by the prize extraction pusher;

an optical sensor at the retrieval bin for determining that a prize has been received by the retrieval bin, the sensor communicating a signal to the controller;

a vacuum source;

a replacement prize storage container, spaced from the rotating playing field, housing a plurality of replacement prizes; and a prize replacement pick-up device operably connected to the vacuum source, the prize replacement pick-up device configured to travel between the replacement prize storage container and the rotating playing field;

wherein the prize replacement pick-up device removes a replacement prize from the replacement prize storage container using the vacuum source in response to the signal from the optical sensor being received by the controller, and wherein the vacuum source disconnects from the prize replacement pick-up device when the prize replacement pick-up device is over the rotating playing field to drop the replacement prize on the rotating playing field.

* * * * *